United States Patent [19]

Dubost et al.

[11] 4,189,334

[45] Feb. 19, 1980

[54] PROCESS FOR THERMAL TREATMENT OF THIN 7000 SERIES ALUMINUM ALLOYS AND PRODUCTS OBTAINED

[75] Inventors: Bruno Dubost; Jean Bouvaist, both of Grenoble, France

[73] Assignee: Cegedur Societe de Transformation de l'Aluminium Pechiney, Paris, France

[21] Appl. No.: 954,768

[22] Filed: Oct. 26, 1978

[30] Foreign Application Priority Data

Nov. 21, 1977 [FR] France ..... 77 35672

[51] Int. Cl.[2] ..... C22F 1/04

[52] U.S. Cl. ..... 148/159; 148/32.5

[58] Field of Search ..... 148/159, 12.7 A, 11.5 A, 148/32, 32.5

[56] References Cited

U.S. PATENT DOCUMENTS

| | | | |
|---|---|---|---|
| 3,706,606 | 12/1972 | Russo et al. | 148/12.7 A |
| 3,791,880 | 2/1974 | Hunsicker et al. | 148/159 |
| 3,856,584 | 12/1974 | Cina | 148/159 |
| 4,019,927 | 4/1977 | Bouvaist | 148/159 |

OTHER PUBLICATIONS

Gruhl et al., "Aushärtungszustand und Spannungsrisskorrosionsverhalten von AlZnMg3", Z. für Metallkunde, vol. 55, 10, 1964, pp. 577–582.

*Primary Examiner*—L. Dewayne Rutledge

*Assistant Examiner*—Peter K. Skiff

*Attorney, Agent, or Firm*—Dennison, Dennison, Meserole & Pollack

[57] ABSTRACT

A process for the thermal treatment of thin products made of 7000 series aluminum alloys comprising a solution heat treatment, quenching treatment and a tempering treatment in three stages:

pretempering between 100° and 150° C. for 5 minutes to 24 hours;

intermediate tempering; and, final tempering between 100° and 160° C. for 2 to 48 hours.

Intermediate tempering comprises a rapid rise in temperature to 190° C. followed by a treatment at a temperature $\theta(t)$ between 190° and 250° C. for a total duration T in such a way that the function:

$$R(T) = \frac{10^{10}}{1.5} \int_{o}^{T} e^{\frac{-13400}{\theta(t)}} dt$$

is comprised between 0.5 and 1.5; and

T and t being expressed in seconds and $\theta(t)$ in °K.

This tempering treatment imparts to the products treated both high mechanical characteristics and a high resistance to stress corrosion.

10 Claims, No Drawings

PROCESS FOR THERMAL TREATMENT OF THIN 7000 SERIES ALUMINUM ALLOYS AND PRODUCTS OBTAINED

BACKGROUND OF THE INVENTION

The present invention relates to a process for the thermal treatment of high strength aluminum alloys of the 7000 series of the Al-Zn-Mg-Cu type, containing between 0.05% and 5%, by weight, of Cu. It applies to thin products, that is to say, to sheets, strips and tubes at most 15 mm thick and to long products such as bars, sections etc., or products of any shape, to those having an equivalent thickness at most equal to 15 mm, i.e., the equivalent thickness is double the ratio of the volume to the sum of the lateral surfaces.

Conventional treatment for hardening such alloys comprise the following stages, in order:

1—solution heat treatment;

2—quenching; and,

3—tempering, or ageing.

optionally with cold plastic deformation of 1 to 5% between the second the third stages for stress-relieving the products in the crude state of quenching.

This plastic deformation is generally obtained by controlled stretching in the case of flat products, TXX51 state.

The tempering treatment leading to the highest mechanical tensile characteristics generally involves increasing the temperature to below 140° C., keeping the temperature isothermal and cooling. This state is known as a T6, or T651 state, leads to a very poor resistance to stress corrosion in the short transverse direction and to exfoliation corrosion.

In order to overcome this disadvantage, a treatment involving a first isothermal step at a temperature below 140° C. followed by a second isothermal step at a temperature above 150° C. and cooling is generally practiced, each step being preceded by a slow rise in temperature. It is intended to impart to the alloys a high resistance to stress corrosion in the short transverse direction, but this is associated with a very substantial reduction in their mechanical characteristics with respect to the T6, or T651 state.

This state is known by those skilled in the art as the T73, or T7351 state.

There is finally a tempering treatment intended to impart to rolled products mechanical tensile characteristics and resistance to stress corrosion which fall between those of the T6, or T651 and T73, or T7351 states, with a high resistance to exfoliation corrosion. This tempering treatment is similar to the T73, or T7351 state tempering treatment, but the periods of treatment are generally shorter in it. This state is known as a T76, or T7651 state, by those skilled in the art, and is applied to sheets of thin or medium thickness.

The resistance to stress corrosion is generally evaluated on samples, which have been cut out in the short transverse direction, by means of alternate immersion and emersion tests, e.g., 10 minutes–50 minutes, in a reagent containing 3.5% NaCl in accordance with American Standard ASTM G44-75, Standard Recommended Practice for Alternate Immersion Stress Corrosion Testing in 3.5% Sodium Chloride Solution.

The resistance to exfoliating corrosion is evaluated by the Exco test in accordance with American Standard ASTM G34-72, Standard Method of Test for Exfoliation Corrosion Susceptibility in 7XXX Series Copper-Containing Aluminum Alloys.

THE INVENTION

However, it has been found that it is possible to simultaneously obtain these two normally opposed properties of high mechanical tensile characteristics and high resistance to stress corrosion if tempering, as in stage 3 above, comprises the following stages:

(3a) pre-tempering in the zone from 100° to 150° C. for a period lasting from 5 minutes to 24 hours;

(3b) intermediate tempering at a higher temperature; and, (3c) final tempering for 2 to 48 hours at between 100° and 160° C.

A treatment of this general type is described in French Pat. No. 2,249,176, published May 5, 1975. It comprises a short period of intermediate isothermal tempering performed in practice by immersing very small products, cross-section of 1 $cm^2$, in a metallic bath such as Wood's metal. It is known that the immersion of aluminum alloys in a medium of this type can lead to severe intergranular brittleness of the said alloys. Moreover, employing such a heating medium is rarely practical owing to the difficulties in employing it, due in particular, to its high density, particularly in the case of the treatment of large-sized products, for example, sheets of thin or medium thickness.

Finally, the treatment described in the French Pat. No. 2,249,176 cannot be applied industrially to products for which, in the majority of cases, the thermal evolution of the articles cannot be considered as isothermal, this being the case with products, even if thin, in industrial tempering furnaces.

It has surprisingly been found that it is by no means necessary to maintain an isothermal temperature during intermediate tempering and that products having good mechanical characteristics as well as good characteristics of resistance to stress corrosion or exfoliating corrosion could be obtained by an intermediate tempering treatment comprising, for example, only one rise in temperature immediately followed by cooling.

More generally, the intermediate tempering treatment according to the invention comprises a rise in temperature at a rate higher than about 1° C. per minute, in a temperature range of between 150° C. and 190° C., followed by a rise in the temperature of the product ($\theta$) as a function of the time (t), thus $\theta$ (t), comprising at least one period of time at a temperature above 190° C. for a total period T in such a way that the function:

$$R(T) = \frac{10^{10}}{1.5} \int_{o}^{T} e^{\frac{-13400}{\theta(t)}} dt$$

be comprised within the limits defined hereafter, wherein:

e is the base of Naperian logarithms;

T is the total period, in seconds, of this stage, starting from the moment when the temperature of the product reaches 190° C. for the first time, in the sense of the rise in the temperature;

$\theta$(t) is the temperature in °K above 463° K., that is 190° C., of the coldest point of the product;

t is the time in seconds; and the temperature $\theta$(t) always being less than 523° K., 250° C., and, preferably, below 508° K., 235° C.

Stages 3a, 3b and 3c can either be separated by returns to a temperature below or equal to that of the previous stage, in particular, to ambient temperature, or can be carried out continuously.

It has been observed that the intermediate tempering conditions leading to the optimum properties actually depend upon the existence, or non-existence, or stress-relieving treatment carried out after quenching; it involves a plastic deformation by stretching, for example, of 1.5 to 3%, preferably 2%. In the absence of such a treatment, the parameter R(T) must be comprised between:

$$0.50 \leqq R(T) \leqq 1.50$$

preferably between 0.75 and 1.25; on the other hand, with a treatment of stress-relieving by plastic deformation after quenching, R(T) must be comprised between 0.5 and 1.25 and, preferably, between 0.5 and 1.

Furthermore, if intermediate tempering comprises an isothermal tempering at a temperature $\theta$, its duration is less than the time To, in minutes, such that:

$34 \log To = 225 - \theta$, $\theta$ being in °C.; and log = decimal logarithm.

In fact, it has been observed that, the higher the temperature of intermediate tempering, the greater the reduction in the mechanical tensile stresses is achieved in longer tempering periods on thin products for which the speed of the increase in temperature is high, particularly if the products have been subjected to a plastic deformation after quenching.

In addition, the periods of treatment according to the invention are shorter at a given temperature than the minimum periods indicated in the above-mentioned French Pat. No. 2,249,176.

The products treated in accordance with the invention have the following properties:

(1) Mechanical tensile characteristics, in particular in the short transverse direction, are equivalent to those obtained after a conventional treatment of maximum hardening known as a T6, or T651, state. Their mechanical characteristics of strength, tensile stress, and yield stress, at 0.2% residual elongation, are greater than or equal to 95% of those obtained with a T6 state treatment carried out on the same alloy, for example for 24 hours at 120° C. for the 7475 alloy.

(2) The stress corrosion resistance is greater than that obtained after a T76, or T7651 state treatment and at least equal to that obtained with a T73, or T7351 state treatment. Moreover, the resistance to exfoliation corrosion in the EXCO test, according to American Standard ASTM G34-72, is at least equal to that of the T76, or T7651, state for thin products.

One of the important advantages of the present invention is that once the thermal kinetics of the products during the intermediate tempering treatment are known by any means, for example with the aid of thermocouples or by experiments on products of given shape which are heated under reproducible conditions, it is possible to control and to stop the said treatment so as to obtain optimum properties from it. The R(T) function may be calculated by any known means, optionally in real time.

Another advantage of the present invention is that products having more reproducible properties of use can be obtained owing to the fact that the same value of R leads to identical structures and properties, thus allowing the effect of slight differences between the thermal cycles to be eliminated from one treatment to another or from one furnace to another.

The heating means used for the intermediate tempering stage are of any known type but, preferably by immersion in a fluid, liquid or gaseous, such as salt or oil baths, tunnel surfaces, etc.

Furthermore, it has been observed that it is advantageous to combine the treatment described above with a homogenization treatment and/or solution heat treatment performed at a temperature $\theta$ between the initial melting temperature $\theta p$ of the metastable eutectics and the initial melting temperature $\theta s$ of the alloy under the conditions of thermodynamic equilibrium, i.e., solidus. A treatment of this general type is described in French Pat. No. 2,278,785, published Feb. 2, 1976. In addition to a significant increase in the mechanical characteristics and in the stress corrosion resistance, an improvement in the toughness is also observed, as measured by the parameter Kc determined in accordance with the ASTM recommendation "Proposed Recommended Practice for R Curve Determination", pages 811 to 825 of Part 10 of Annual Book of ASTM Standards, 1975.

In addition, it has been observed that upon leaving intermediate tempering, the products treated already have satisfactory mechanical tensile characteristics and stress corrosion resistance which are comparable to those of the T73 state and a toughness measured by the parameter Kc which is clearly superior to that obtained with final tempering.

It may therefore be interesting in certain cases not to carry out final tempering.

EXAMPLES

The above invention is illustrated by the following examples which demonstrate the great flexibility of this method for adaptation to products of various thicknesses or to different heating methods employed for the thermal treatment of the 7000 series Al-Mg-Zn-Cu alloys. The examples in no way limit the scope claimed by the present invention:

Example I

A strip of sheet metal made of 7475 alloy, 2 mm thick in the initial T351 state has been treated in the following manner: pre-tempering in a combustion furnace, air cooling, intermediate tempering in a tunnel furnace 30 m long preregulated to a certain outlet temperature $\theta F$, at a speed of travel V, air cooled, final tempering in combustion furnace under the conditions indicated in Table I. Furthermore, the C test has been performed by heating during intermediate tempering in a salt bath (nitrites-nitrates) pre-regulated to the $\theta F$ temperature of 230° C., air outlet.

The results of the mechanical characteristics (long transverse direction) and of the corrosion tests are indicated in Table I.

It is observed that the yield stress and the tensile stress for the thermal treatment according to the invention are substantially higher than 95% of those of the T6 state.

Example II

Metal sheets 8mm thick made of 7475 alloy have been treated in the T351 state by triple tempering in different media (salt or oil baths) at various temperatures $\theta F$ for intermediate tempering under the conditions indicated in Table II. The T651 treatment has also been carried out for comparison purposes.

The results of the mechanical characteristics (long transverse direction) and of the exfoliating corrosion tests are indicated in Table II.

It is observed that the values of R(T) which are too high (Test A) or too low (Test B) lead to a poor compromise between mechanical characteristics and corrosion resistance. On the other hand, the C Test according to the invention leads to a satisfactory compromise.

Example III

Metal sheets 8 mm thick made of 7475 alloy in the T351 state have been treated in the following manner:

TEST A conventional solution heat treatment (maximum temperature 468° C.)

tempering according to the invention under the same conditions as in Example II.

TESTS B AND C conventional homogenization at 460° C.;

special solution heat treatment at 515° C. under the conditions described in French Pat. No. 2,278,785; and conventional T7651 tempering (Test B) or tempering according to the invention (Test C).

The tempering treatments were stopped at the outlet of the salt bath furnace.

TEST D special homogenization at 515° C.;

special solution heat treatment at 510° C.; and tempering according to the invention.

The results have been indicated in Table III.

It is observed that the mechanical characteristics, i.e., yield stress, tensile stress, toughness Kc, are improved when the solution heat treatment and homogenization treatment according to French Pat. No. 2,278,785 are used in combination with the tempering treatment according to the invention.

Example IV

Metal sheets 5 mm thick made of 7049 alloy in the T351 state have been treated in the following manner:

Test A—(T651 state): tempering for 48 hours at 120° C.;

Test B—(T7351 state): tempering for 24 hours at 120° C.+16 hours at 160° C.; and Test C—(according to the invention):

pretempering for 4 hours at 120° C.;

intermediate tempering in tunnel furnace pre-regulated to an outlet temperature of 215° C.: duration of passage 2 minutes, 15 seconds (speed of travel 15 m per min - cooling air - R: 0.81).

complementary tempering: 24 hours at 120° C.

Table IV shows the improvement over the present state T7351, in the mechanical tensile characteristics measured in the long transverse direction and of the resistance of exfoliating corrosion of the sheets, EXCO test, of the products treated according to the invention.

See tables below:

TABLE 1

| | Tempering (a) | | | | | | | | Mechanical Characteristics (b) | | | |
|---|---|---|---|---|---|---|---|---|---|---|---|---|
| | Pre-tempering | | Intermediate tempering | | | | Final tempering | | | | | Resistance To Exfoliating Corrosion (EXCO test) |
| Test Labels | $\theta_1$ (°C.) | $t_1$ (h) | V m/mn | $\theta F$ (°C.) | t (mn,sec) | R(T) (c) | $\theta_3$ (°C.) | $t_3$ (hours) | Rp 0.2 MPa | Rm MPa | A % | |
| A | 120 | 2 | 12 | 215 | 2'30" | 1.02 | 120 | 48 | 482 | 561 | 13.5 | good |
| B | 120 | 2 | 10 | 210 | 3' | 0.91 | 140 | 16 | 473 | 543 | 11.2 | good |
| C | 120 | 2 | (d) | 230 | (e) 55" | 1.25 | 140 | 16 | 467 | 538 | 16.5 | good |
| D (f) | 120 | 24 | — | — | — | — | — | — | 470 | 550 | 12.0 | poor |

(a) tempering for t (hours) at $\theta$(°C.)
(b) long transverse direction
(c) values of R(t) according to the description
(d) treatment in salt baths
(e) total duration of immersion
(f) T 651 state

TABLE II

| | Tempering (a) | | | | | | | | Mechanical Characteristics | | | |
|---|---|---|---|---|---|---|---|---|---|---|---|---|
| | Pre-tempering | | Intermediate tempering | | | | Final tempering | | | | | Resistance to Exfoliating Corrosion (EXCO test) |
| Test Labels | $\theta_1$ (°C.) | $t_1$ (h) | Medium (C) | $\theta F$ (°C.) | t (mn,sec) | R(T) (d) | $\theta_3$ (°C.) | $t_3$ (hours) | Rp 0.2 MPa | Rm MPa | A % | |
| A | 120 | 2 | S | 235 | 3' | 2.56 | 120 | 24 | 430 | 496 | 12.7 | good |
| B | 120 | 2 | H | 220 | 6' | 0.48 | 120 | 24 | 472 | 552 | 16.1 | poor |
| C | 120 | 2 | S | 212 | 2'30" | 1.10 | 120 | 48 | 478 | 547 | 12.3 | good |
| D(e) | 120 | 24 | — | — | — | — | — | — | 464 | 554 | 17 | poor |

(a) tempering for t(h) at $\theta$(°C.)
(b) long transverse direction
(c) S: salt—H: oil
(d) value of R(T) according to the description
(e) T651 state

TABLE III

| Tests | Treatment before quenching | Tempering: Pre-tempering $\theta_1$ (°C.) | Pre-tempering $t_1$ (h) | Intermediate tempering: Rise (mn,s) | Intermediate tempering: $\theta$ (°C.) | Intermediate tempering: Maint. (mn,s) | Intermediate tempering: reft. | R(T) c | Final tempering: $\theta_3$ (°C.) | Final tempering: $t_3$ (h) | Mechanical Characteristics: Rp 0.2 MPa | Rm MPa | A % | Kc MPa $\sqrt{m}$ | Resistance To Exfoliating Corrosion EXCO test |
|---|---|---|---|---|---|---|---|---|---|---|---|---|---|---|---|
| A | Conventional | 120 | 2 | 2'45" | 212 | 0 | Air | 1.10 | 120 | 24 | 457 | 554 | 12.4 | 147 | Good |
| B | Special | 120 | 4 | — | — | — | — | — | 160 | 15 | 437 | 508 | 13.5 | 171 | Good |
| C | Special | 120 | 2 | 2'30" | 215 | 0 | Air | 1.14 | 120 | 48 | 489 | 559 | 12.7 | 156 | Good |
| D | Special | 120 | 4 | 2' | 218 | — | Air | 1.23 | 120 | 24 | 483 | 552 | 13.2 | 174 | Good |

TABLE IV

| Test | Mechanical Characteristics in long transverse direction: Rm (MPa) | Rp0.2 (MPa) | A % | Resistance to Exfoliating Corrosion (EXCO) |
|---|---|---|---|---|
| a | 557 | 602 | 14.0 | Medium (pits with exfoliating tendency) |
| B | 485 | 540 | 12.5 | good (pits) |
| C | 542 | 593 | 12.3 | good (pits) |

We claim:

1. In a process for the thermal treatment of a thin product, having an equivalent thickness of less than about 15 mm, comprising 7000 series aluminum base alloy of the Al-Zn-Mg-Cu type, containing about 0.4% to 5%, by weight of copper, and comprising a solution heat treatment, quenching and tempering, the improvement comprising effecting tempering in three stages:

(a) pre-tempering within a temperature range of about 100° to 150° C. for a period lasting from about 5 minutes to 24 hours;

(b) intermediate tempering comprising a continuous increase in temperature immediately followed by continuous cooling without an isothermal plateau; and, (c) final tempering for about 2 to 48 hours at between about 100° and 160° C., wherein said intermediate tempering comprises a rise in temperature at a rate above about 1° C. per minute in a temperature range from about 150° C. to 190° C., followed by an increase in the temperature of the product ($\theta$) as a function of the time (t) whatever $\theta(t)$, comprising at least one period at a temperature above 190° C. for a total duration T, such that the function:

$$R(T) = \frac{10^{10}}{1.5} \int_{o}^{T} e^{\frac{-13400}{\theta(t)}} dt$$

is comprised between 0.5 and 1.5 and in which:

e is the base of Naperian logarithms;

T is the total duration, in seconds, of this portion of stage (b), starting from the time when the temperature of the product, as it is increasing in temperature, reaches a temperature of about 190° C. for the first time;

$\theta(t)$ is the temperature in °K of the coldest point of the product above about 463° K. (190° C.) and below about 523° K. (250° C.); and t is the time in seconds.

2. A process according to claim 1 in which a treatment for release of stress by cold plastic deformation is applied to the product after the quenching treatment, wherein the values of R are comprised between 0.5 and 1.25.

3. A process according to claim 1, wherein $0.75 \leqq R(T) \leqq 1.25$.

4. A process according to claim 2, wherein $0.5 \leqq R(T) \leqq 1$.

5. A process according to claim 1, wherein intermediate tempering is directly preceded and/or followed by treatment of the product at a temperature below or equal to that of the directly preceding stage, in particular at ambient temperature.

6. A process according to claim 1, wherein at least two of the three tempering stages are carried out continuously.

7. A process according to claim 1, wherein tempering is preceded by hardening carried out with a solution heat treatment temperature of between $\theta p$, the melting temperature of the metastable eutectics and $\theta s$, the initial melting temperature of the alloy under conditions of equilibrium, solidus.

8. A process according to claim 1, wherein the treatment prior to tempering comprises a homogenization treatment carried out at a temperature of between $\theta p$ and $\theta s$.

9. The product produced by the process of claim 1, wherein the mechanical characteristics of strength, tensile stress and yield stress of the product are higher than 95% of those imparted to a product obtained by a conventional T6 treatment and that the resistance to stress corrosion or exfoliation corrosion, is at least equal to that imparted to a product by a conventional T73 treatment and greater than that obtained by a conventional T76 treatment.

10. In a process for the thermal treatment of a thin product, having an equivalent thickness of less than about 15 mm, comprising 7000 series aluminum base alloy of the Al-Zn-Mg-Cu type, containing about 0.4% to 5%, by weight of copper, and comprising a solution heat treatment, quenching and tempering, the improvement comprising effecting tempering in stages comprising:

(a) a first pre-tempering stage within a temperature range of about 100° to 150° C. for a period lasting from about 5 minutes to 24 hours; and (b) a second tempering stage comprising a continuous increase in temperature immediately followed by continuous cooling without an isothermal plateau, wherein said second tempering stage comprises a rise in temperature at a rate above about 1° C. per minute in a temperature range from about 150° C. to 190° C., followed by an increase in the temperature of the product ($\theta$) as a function of the time (t) whatever $\theta(t)$, comprising at least one period at a temperature above 190° C. for a total duration T, such that the function:

$$R(T) = \frac{10^{10}}{1.5} \int_{o}^{T} e^{\frac{-13400}{\theta(t)}} dt$$

is comprised between 0.5 and 1.5 and in which:

e is the base of Naperian logarithms;

T is the total duration, in seconds, of this portion of stage (b), starting from the time when the temperature of the product, as it is increasing in temperature, reaches a temperature of about 190° C. for the first time;

$\theta$(t) is the temperature in °K. of the coldest point of the product above about 463° K. (190° C.) and below about 523° K. (250° C.); and t is the time in seconds.

* * * * *